US007274145B2

(12) United States Patent
Chen et al.

(10) Patent No.: US 7,274,145 B2
(45) Date of Patent: Sep. 25, 2007

(54) PLASMA DISPLAY PANEL HAVING BUMPS ON BARRIER RIBS

(75) Inventors: Yu-Sheng Chen, Padeh (TW); Chih-Hsiung Leu, Padeh (TW); Chung-Wang Chou, Padeh (TW)

(73) Assignee: Chunghwa Picture Tubes, Ltd, Taoyuan (TW)

( * ) Notice: Subject to any disclaimer, the term of this patent is extended or adjusted under 35 U.S.C. 154(b) by 165 days.

(21) Appl. No.: 10/986,311

(22) Filed: Nov. 12, 2004

(65) Prior Publication Data

US 2006/0103306 A1 May 18, 2006

(51) Int. Cl.
*H01J 17/49* (2006.01)

(52) U.S. Cl. ..... 313/587; 313/582

(58) Field of Classification Search ..... 345/37, 345/41, 60, 71; 313/582–587; 315/169.4
See application file for complete search history.

(56) References Cited

U.S. PATENT DOCUMENTS

2002/0163304 A1* 11/2002 Akiba ..... 313/584
2003/0102804 A1* 6/2003 Mitomo ..... 313/586

FOREIGN PATENT DOCUMENTS

TW 466537 B 12/2001
TW 493194 B 7/2002

* cited by examiner

*Primary Examiner*—Vip Patel
*Assistant Examiner*—Bumsuk Won
(74) *Attorney, Agent, or Firm*—Birch, Stewart, Kolasch & Birch, LLP

(57) ABSTRACT

A plasma display panel and method are provided. The method includes that a first substrate is provided and elongated electrodes are formed on the first substrate. Then, an overcoat layer is formed on the elongated electrodes and the first substrate. Next, by means of screen print, a shaped layer is formed on the overcoat layer. Screen print is applied again to form bumps on the shaped layer. A second substrate is also provided. The second substrate is extended paralleled with the first substrate so as to define a discharge space between the substrates after combining the two substrates. Bumps are provided between the first and second stripe ribs so as to define passages to let air can flow in the discharge space. By the mentioned processes, bumps are provided between the first and second stripe ribs so as to define passages for drawing air. The process is simple for alignment.

6 Claims, 5 Drawing Sheets

PLASMA DISPLAY PANEL HAVING BUMPS ON BARRIER RIBS

BACKGROUND OF THE INVENTION

1. Field of the Invention

The present invention relates to a plasma display panel and a method for making the same and, more particularly, to a grid-mesh-shaped barrier rib structure of the plasma display panel and a method for making the same.

2. Description of the Related Art

Most barrier rib structures of plasma display panel are a strip-shaped or a grid-mesh-shaped. As shown in FIG. 1, a perspective view of a conventional plasma display panel. A strip-shaped barrier rib 111 is formed on a rear substrate 110 and a grid-mesh-shaped barrier rib 121 is formed on a front substrate 120. And then combine the front substrate 120 with the rear substrate 110 to a plasma display panel 100. Several problems have been encountered by the conventional method.

Firstly, the front substrate 120 is expensive because it has to form a grid-mesh-shaped barrier rib 121. Secondly, it is difficult to combine the front substrate 120 with the rear substrate 110 since they must be precisely aligned. In order to precisely align the front substrate 120 with the rear substrate 110, the aperture ratio of the plasma display panel 100 is compromised since the thickness of the strip-shaped barrier rib 111 of the rear substrate 110 must be made big or the width of the grid-mesh-shaped barrier rib 121 of the front substrate 120 must be enlarged. The effective area of the substrates coated with phosphorous material is reduced as the thickness of the barrier ribs is increased.

As shown in FIG. 1B, a perspective view of another conventional plasma display panel. A grid-mesh-shaped barrier rib 161 is directly formed on a rear substrate 160 of the plasma display panel 150. Bumps 171 are also formed on the place of a front substrate 170 corresponding to that of concaves 162 of the grid-mesh-shaped barrier rib 161 of the rear substrate 160. And then combine the front substrate 170 with the rear substrate 160 to the plasma display panel 150. Some problems also have been encountered.

Firstly, the front substrate 170 is expensive since it needs to form the bumps 171. Secondly, it is difficult to combine the front substrate 170 with the rear substrate 160 since they must be aligned precisely.

The present invention is therefore intended to obviate or at least alleviate the problems encountered in prior art.

SUMMARY OF THE INVENTION

It is an object of the present invention to provide a plasma display panel and a simple process for making the same that overcomes the above-mentioned problems.

Another object of the present invention is to provide a manufacturing method of forming passages on the grid-mesh-shaped barrier rib.

To achieve the above objects, according to the present invention, a plasma display panel includes a first substrate, a second substrate extending paralleled with the first substrate so as to define a discharge space between the first substrate and the second substrate, a plurality of elongated electrodes formed on the first substrate or the second substrate, and paralleled to a first direction, and a grid-mesh-shaped barrier rib formed on the elongated electrodes. The grid-mesh-shaped barrier rib includes a shaped layer and a plurality of bumps. In addition, the shaped layer includes a plurality of first stripe ribs, which separates the discharge space into a plurality of sub discharge spaces and a plurality of second stripe ribs, which defines channels. The channels and the first stripe rib areas are across. The thickness of the bumps defines the passages being communicated with the channels and the sub discharge spaces between the first substrate and the second substrate.

In the method according to the present invention, screen print is used to form a grid-mesh-shaped barrier rib. The method includes the following steps:

A first substrate is provided. The first substrate has a vacuum hole and formed a plurality of elongated electrodes. Each elongated electrode is paralleled to a first direction. An overcoat layer is formed on the elongated electrodes and the first substrate. And then form a shaped layer with channels of a grid-mesh-shaped barrier rib on the overcoat layer by means of screen print. Screen print is applied again to form bumps on the shaped layer as the grid-mesh-shaped barrier rib. A second substrate is provided. The first substrate is paralleled to and combined with the second substrate so as to define a discharge space between the first substrate and the second substrate. The discharge space is communicated with the vacuum hole. The edge of the first substrate is connected with the edge of the second substrate so as to close the discharge space. Each bump includes thickness H. Thus, passages with the thickness H are defined after combining of the first substrate and the second substrate, so that air can flow in the discharge space from the passages. And also air can be driven from the discharge space through the vacuum hole. In detail, air flows from the discharge space to the passages and from the passages to the channels. Finally, air flows through the vacuum hole.

The cost of screen print is cheap. Besides, there is no waste for the material of paste used on the screen print, because the paste is only printed on the specific areas.

Other objects, advantages and novel features of the present invention will become more apparent from the following detailed description referring to the attached drawings.

BRIEF DESCRIPTION OF THE DRAWINGS

The present invention will be described via detailed illustration of embodiments referring to the drawings.

DESCRIPTION OF THE PREFERRED EMBODIMENTS

Figure 1A:
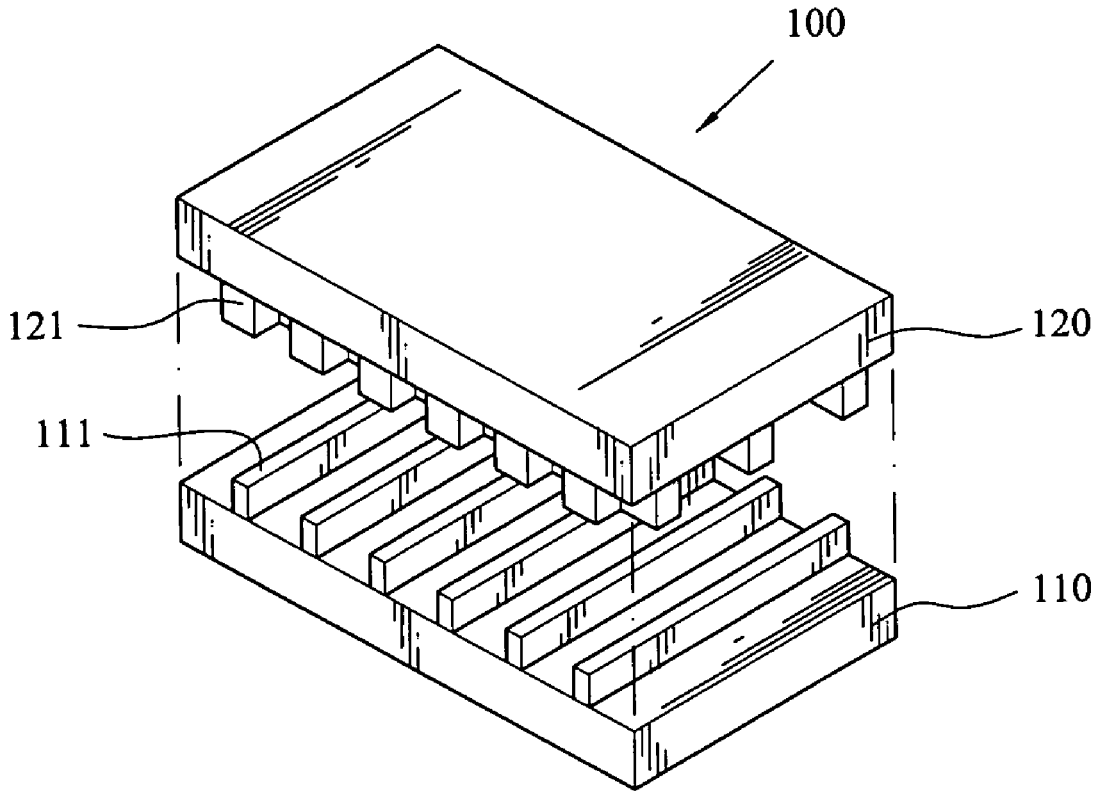
FIG.1A (PRIOR ART)
FIG. 1A is a perspective view of a conventional plasma display panel.
Figure 1B:
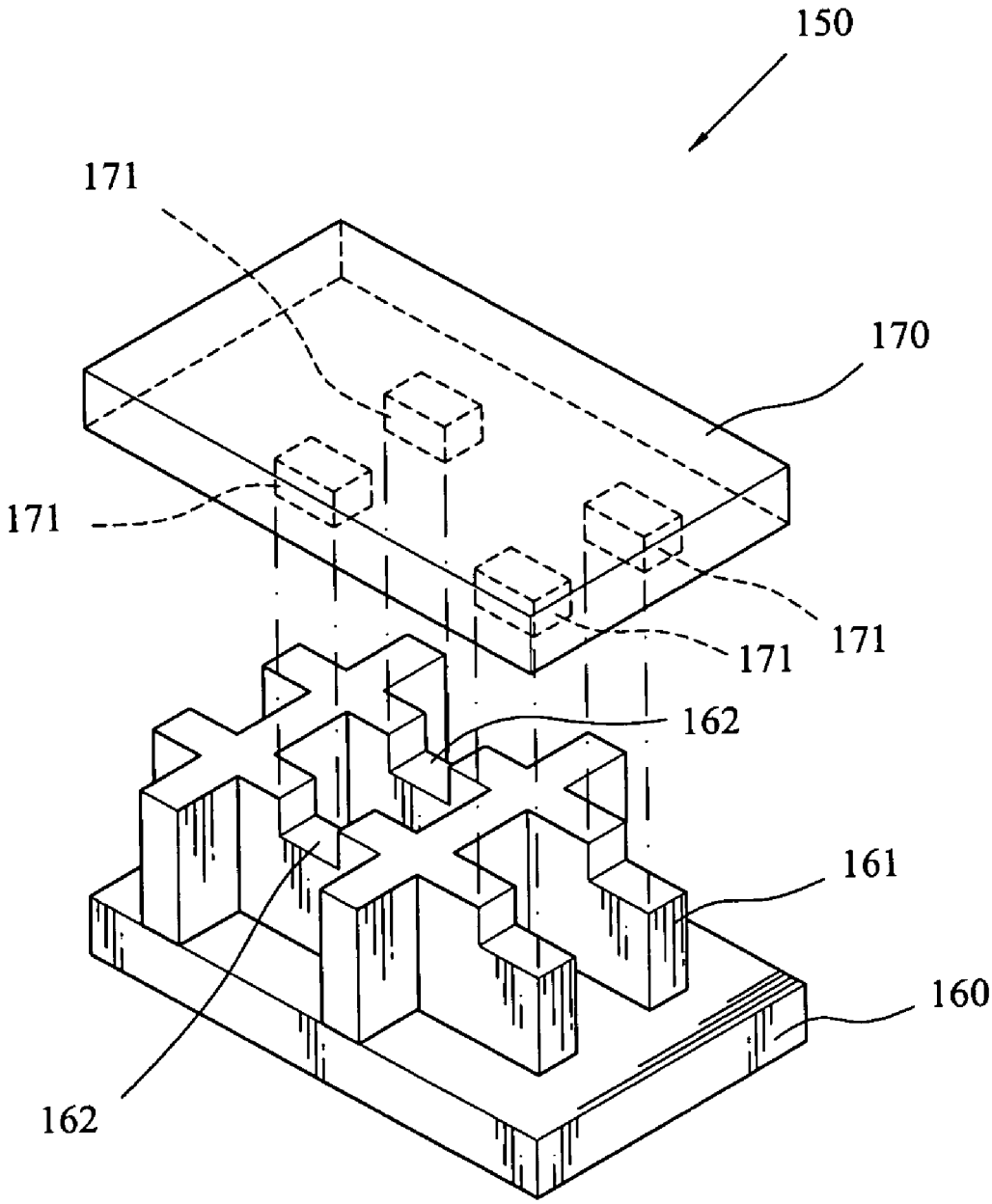
FIG.1B (PRIOR ART)
FIG. 1B is a perspective view of another conventional plasma display panel.
Figure 2:
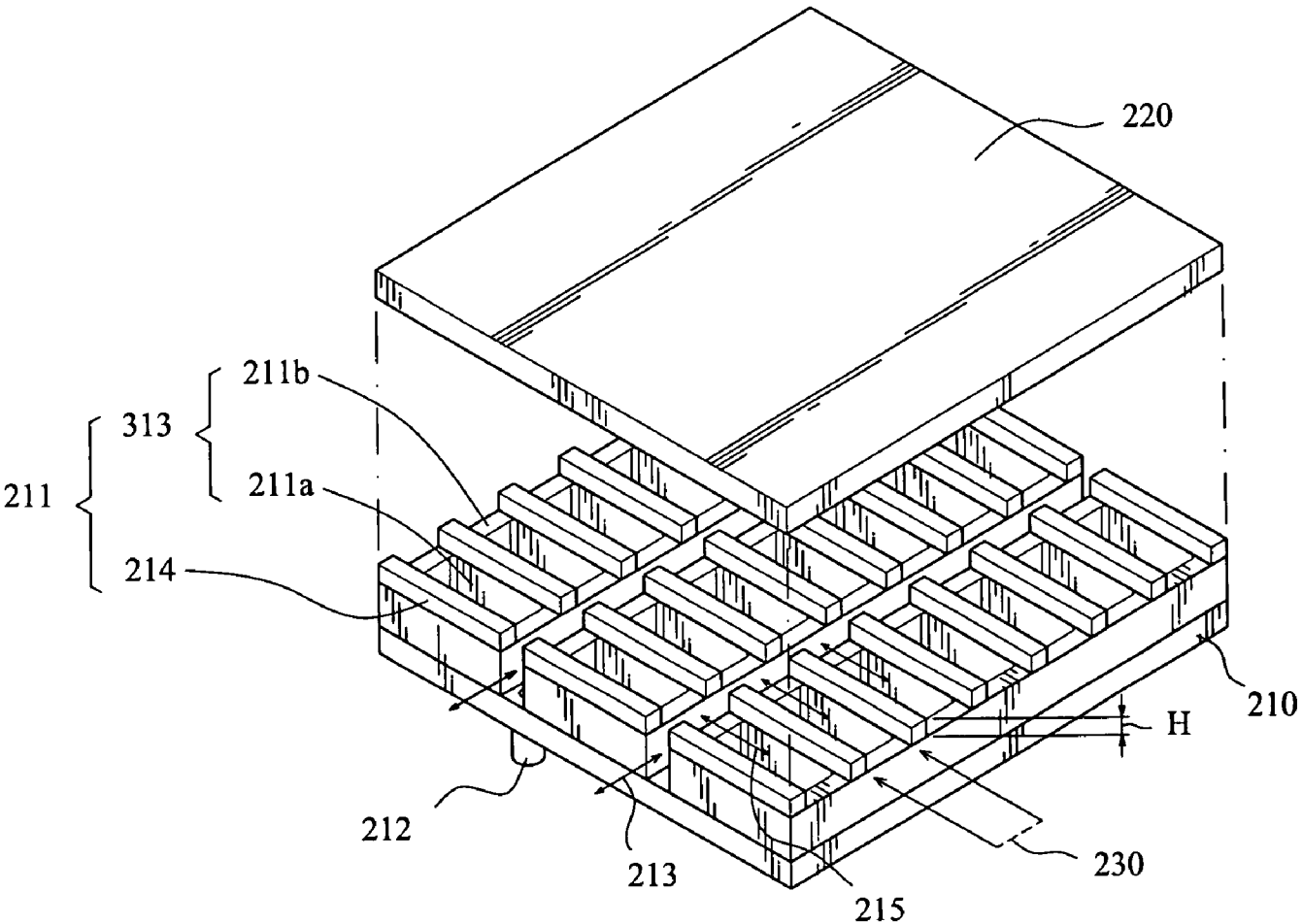
FIG. 2 is a perspective view of a partial structure of a front and a rear substrate of plasma display panel according to the present invention.

As shown in FIG. 2, the plasma display panel includes a first substrate 210 and a second substrate 220 paralleled with the first substrate 210 so as to define a discharge space. A vacuum hole 212, a plurality of elongated electrodes (not shown in the FIG. 2), and an overcoat layer are successively formed on the first substrate 210. Each elongated electrode is paralleled to a first direction (not shown in the FIG. 2) and a grid-mesh-shaped barrier rib 211 is formed on the overcoat layer. The grid-mesh-shaped barrier rib 211 of the first substrate 210 includes a plurality of first stripe ribs 211*a* so as to define a plurality of sub discharge spaces 230 and a plurality of second stripe ribs areas 211*b* intersecting the first stripe ribs 211*a*; each second stripe ribs 211*b* defines a channel 213. A vacuum hole 212 is formed on one of the channels 213, and the depth of the channels 213 is deeper than that of the discharge space. Bumps 214, which include a thickness H, are finally formed on the first stripe ribs 211*a* and the second stripe ribs 211*b* or the intersections of the first stripe ribs 211*a* and the second stripe ribs 211*b*. In addition, the height of the first stripe ribs 211*a* is the same as that of the second stripe ribs 211*b*.

Thus, passages 215 with thickness H are defined after combining of the first substrate 210 and the second substrate 220, so that air can flow to the channels 213 through the passages 215.

A method for making the plasma display panel according to the present invention includes the following steps:

Initially, there is provided a first substrate 210 with a vacuum hole 212 defined therein.

A plurality of elongated electrodes (not shown in the FIG.2) extends in a first direction on the first substrate 210.

An overcoat layer is formed on the elongated electrodes and the first substrate 210 (not shown in the FIG.2).

A grid-mesh-shaped barrier rib 211 is formed on the first substrate 210 by means of screen print. The grid-mesh-shaped barrier rib 211 is composed of a shaped layer 313 and a plurality of bumps 214. The shaped layer 313 includes the plurality of first stripe ribs 211*a* and a plurality of second stripe ribs 211*b*. Each second stripe rib defines a channel 213.

There is provided a second substrate 220 paralleled with the first substrate 210 so as to define a discharge space between the first substrate 210 and the second substrate 220. The discharge space is communicated with the vacuum hole 212.

The edge of the first substrate 210 is connected with the edge of the second substrate 220 so as to close the discharge space. Each bump 214 includes thickness H. Thus, passages 215 with thickness H are defined after combining of the first substrate 210 and the second substrate 220, so that air can flow in the discharge space through the passages 215. For example, flow in the discharge space 230 and the channels 213.

Air is driven from the discharge space 230 through the vacuum hole 212. In detail, air flows from the discharge space 230 to the passages 215 and from the passages 215 to the channels 213 Finally, air flows out the discharge space through the vacuum hole 212.

Figure 3A:
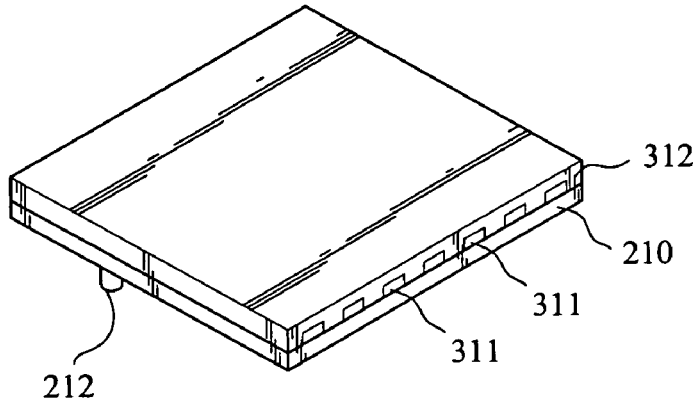
FIGS. 3A to 3C show steps of a method for making the grid-mesh-shaped barrier rib of plasma display panel according to the present invention.
Figure 3B:
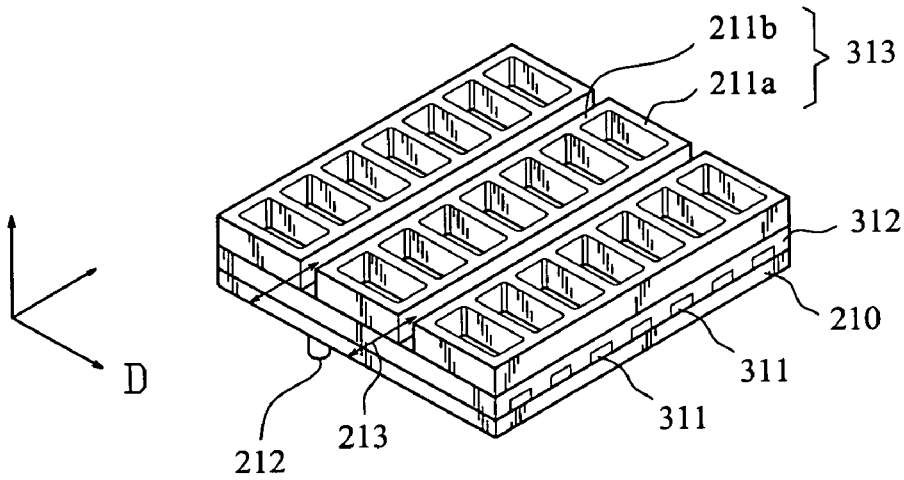
Figure 3C:
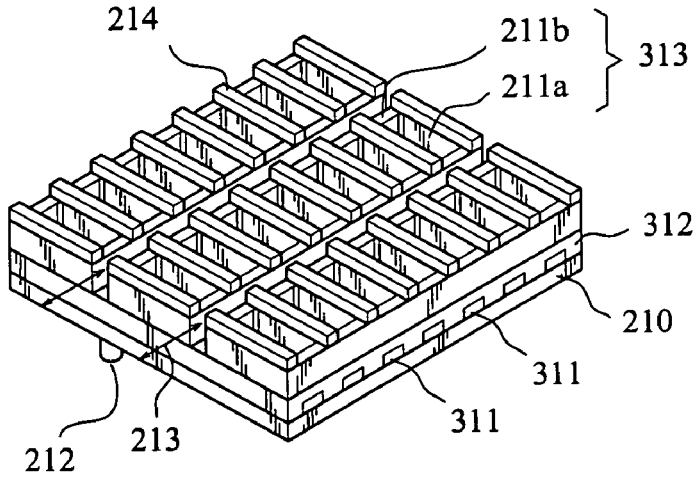

FIGS. 3A to 3C show steps of a method for making the grid-mesh-shaped barrier rib of plasma display panel according to the present invention.

As shown in FIG. 3A, a first substrate 210 is provided. A plurality of elongated electrodes 311 is formed on the first substrate 210. The elongated electrodes 311 extend in a first direction (shown as arrow D direction). An overcoat layer 312 is formed on the elongated electrodes 311 and the first substrate 210.

Then, as shown in FIG. 3B, a shaped layer 313 of grid-mesh-shaped barrier rib is formed on the overcoat layer 312 by means of screen print. The shaped layer 313 includes a plurality of first stripe ribs 211*a* and a plurality of second stripe ribs 211*b* intersecting the first stripe ribs 211*a*. Each first rib 211*a* is formed on a portion of the overcoat layer 312 between any two adjacent elongated electrodes 311. The first stripe rib 211*a* extend in a first direction. The second rib areas 211*b* extend in a second direction perpendicular to the first direction. Each second stripe rib 211*b* defines a channel 213. Finally, as shown in FIG. 3C, by means of screen print again, bumps 214 are formed on the shaped layer 313 due to the cohesion of paste.

Figure 4A:
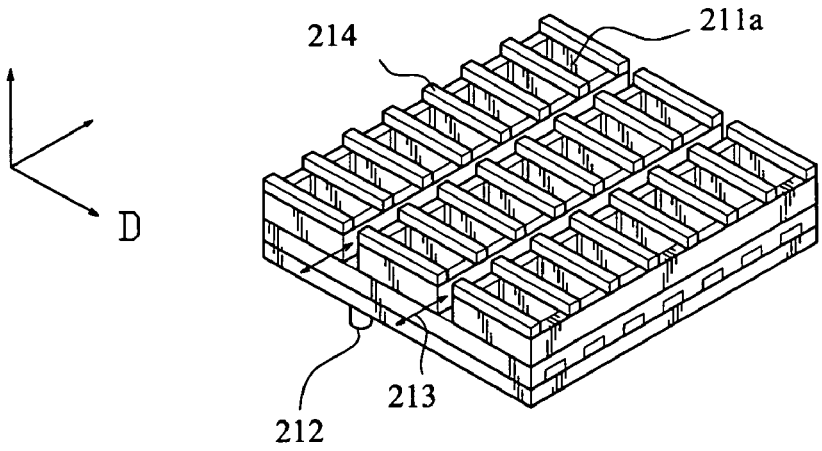
FIGS. 4A to 4C are perspective views of three different types of grid-mesh-shaped barrier rib.
Figure 4B:
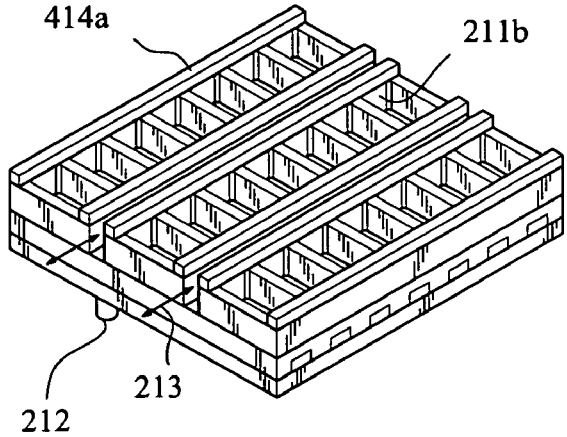
Figure 4C:
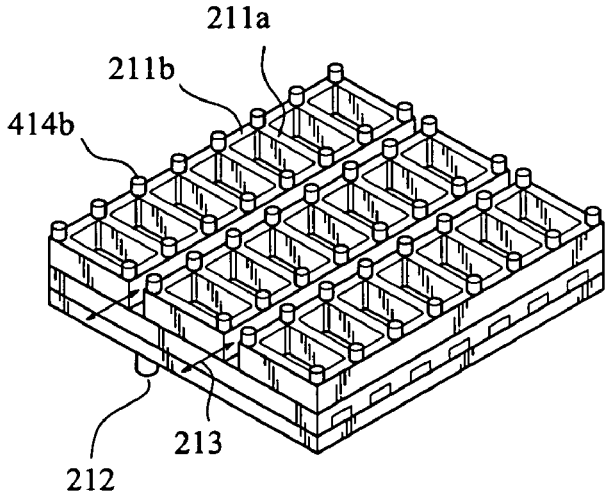

FIGS. 4A to 4C show three different types of forming the grid-mesh-shaped barrier rib 211.

As shown in FIG. 4A, elongated bumps 214 are formed on each first stripe rib 211*a* by means of screen print along a first direction (shown as arrow D). Because of the cohesion of paste, the paste will not flow into the channels 213 but adhere to the first stripe ribs 211*a*.

As shown in FIG. 4B, elongated bumps 414*a* are formed on each second stripe rib 211*b* a by means of screen print along a second direction. Because of the cohesion of paste, the paste will only adhere to the second stripe ribs 211*b*.

As shown in FIG. 4C, bumps 414*b* are formed on each intersection of first stripe rib 211*a* and related one of the second stripe rib 211*b*. In detail, a plurality of drops of paste are provided on intersections of the first stripe ribs 211*a* and the second stripe ribs 211*b* to form the bumps 414*b*.

According to the above manufacturing methods of the grid-mesh-shaped barrier rib, the present invention has following advantages:

Only the rear substrate needs to form stripe ribs, so it is easier for precisely aligned combining of the front substrate and the rear substrate.

Passages formed by the bumps of stripe rib areas are easier to draw air out of the discharge space during the vacuum process of plasma display panel assembly.

The process for forming the rid-mesh-shaped barrier rib is simple. Because of the character of cohesion of paste, the line width on the silk screen can be designed more big than that of the stripe ribs, which will cause a better alignment; moreover, the job can be done by applying twice screen print.

The present invention has been described via detailed illustration of some embodiments. Those skilled in the art can derive variations from the embodiments without departing from the scope of the present invention. Therefore, the embodiments shall not limit the scope of the present invention defined in the claims.

What is claimed is:

1. A plasma display panel, comprising:

a first substrate having a vacuum hole disposed in said first substrate;

a second substrate paralleled with said first substrate so as to define a discharge space between said first substrate and said second substrate;

a plurality of elongated electrodes formed on said first substrate and each elongated electrode extends in a first direction; and a grid-mesh-shaped barrier rib formed on said elongated electrodes, wherein said grid-mesh-shaped barrier rib comprises:

a shaped layer wherein said shaped layer comprises a plurality of first stripe ribs along a first direction which separate said discharge space into a plurality of sub discharge spaces; and a plurality of second stripe ribs intersecting said first stripe rib areas, wherein each of said second stripe ribs defines a channel, and the depth of the channel is deeper than that of the discharge space; and a plurality of bumps with a thickness formed on said shaped layer to define passages between said first substrate and said second substrate, wherein said passages are communicated with said discharge space.

2. The plasma display panel according to claim 1 wherein said bumps are elongated bumps formed on said first stripe ribs.

3. The plasma display panel according to claim 1 wherein said bumps are elongated bumps formed on said second stripe ribs.

4. The plasma display panel according to claim 1 wherein said bumps are formed on intersections of said first stripe ribs with said second stripe ribs.

5. The plasma display panel according to claim 1 wherein an overcoat layer is formed on said elongated electrodes.

6. The plasma display panel according to claim 1 wherein the height of said first stripe ribs is the same as that of said second stripe ribs.

* * * * *